US010798501B2

(12) United States Patent
Andersen et al.

(10) Patent No.: US 10,798,501 B2
(45) Date of Patent: Oct. 6, 2020

(54) AUGMENTED HEARING DEVICE

(71) Applicant: Sonion Nederland B.V., Hoofddorp (NL)

(72) Inventors: Morten Kjeldsen Andersen, Hoofddorp (NL); Hamidreza Taghavi, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/554,172

(22) Filed: Aug. 28, 2019

(65) Prior Publication Data

US 2019/0387333 A1 Dec. 19, 2019

Related U.S. Application Data

(63) Continuation of application No. 15/254,969, filed on Sep. 1, 2016, now Pat. No. 10,433,077.

(30) Foreign Application Priority Data

Sep. 2, 2015 (EP) ..... 15183445

(51) Int. Cl.

| | |
|---|---|
| ***H04R 25/00*** | (2006.01) |
| ***H04R 1/24*** | (2006.01) |
| ***H04R 1/10*** | (2006.01) |
| ***H04R 3/14*** | (2006.01) |

(52) U.S. Cl.

CPC ..... *H04R 25/604* (2013.01); *H04R 1/24* (2013.01); *H04R 25/43* (2013.01); *H04R 25/505* (2013.01); *H04R 25/554* (2013.01); *H04R 1/1008* (2013.01); *H04R 3/14* (2013.01); *H04R 2225/33* (2013.01)

(58) Field of Classification Search

CPC ..... H04R 25/604; H04R 1/24; H04R 25/43; H04R 25/505; H04R 25/554; H04R 2225/33; H04R 1/1108; H40R 3/14

USPC ..... 381/312

See application file for complete search history.

(56) References Cited

U.S. PATENT DOCUMENTS

| | | | |
|---|---|---|---|
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |

(Continued)

OTHER PUBLICATIONS

Extended European Search Report for Application No. EP 15183445.4, date of completion of search: Feb. 4, 2016 (4 pages).

*Primary Examiner* — Sean H Nguyen
(74) *Attorney, Agent, or Firm* — Nixon Peabody LLP

(57) ABSTRACT

The present invention relates to an augmented hearing device comprising a receiver of a first type being adapted to generate sound signals in a first and in a second frequency range, a receiver of a second type being adapted to generate sound signals in a third frequency range, said third frequency range being between the first and second frequency ranges, and an input port for receiving signals to be reproduced as sound signals via at least one of the receivers. The input port may be arranged to receive wireless input signal, such as Bluetooth input signals. The present invention further relates to a method for operating a hearing device.

22 Claims, 7 Drawing Sheets

(56) References Cited

U.S. PATENT DOCUMENTS 6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 Van Doorn
7,088,839 B2 8/2006 Geschiere
7,110,560 B2 9/2006 Stenberg
7,110,562 B1 9/2006 Feeley
7,136,496 B2 11/2006 van Halteren
7,142,682 B2 11/2006 Mullenborn
7,181,035 B2 2/2007 van Halteren
7,190,803 B2 3/2007 van Halteren
7,194,103 B2 3/2007 Harvey
7,206,428 B2 4/2007 Geschiere
7,221,767 B2 5/2007 Mullenborn
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,029 B2 1/2012 Ngia
8,103,039 B2 1/2012 van Halteren
8,160,290 B2 4/2012 Jorgensen
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
9,055,366 B2 6/2015 Azmi
2004/0209654 A1* 10/2004 Cheung ..... H04S 1/00 455/567
2006/0133636 A1 6/2006 Harvey
2009/0161895 A1* 6/2009 Hruza ..... H04R 1/1083 381/309
2011/0058702 A1 3/2011 Saggio
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0255805 A1 10/2012 van Halteren
2013/0028451 A1 1/2013 de Roo
2013/0136284 A1 5/2013 van Hal
2013/0142370 A1 6/2013 Engbert
2013/0163799 A1 6/2013 Van Halteren
2013/0195295 A1 8/2013 van Halteren
2013/0343584 A1* 12/2013 Bennett ..... H04R 25/554 381/315
2014/0205131 A1* 7/2014 Azmi ..... H04R 1/1075 381/380

* cited by examiner

AUGMENTED HEARING DEVICE

CROSS-REFERENCE TO RELATED APPLICATIONS

This application is a continuation of U.S. patent application Ser. No. 15/254,969, filed Sep. 1, 2016, now allowed, which claims the benefit of and priority to European Patent Application Serial No. EP 15183445.4, filed Sep. 2, 2015, and titled "Augmented Hearing Device,", all of which are incorporated herein by reference in their entireties.

FIELD OF THE INVENTION

The present invention relates to an augmented hearing device comprising a plurality of acoustical receivers of different kinds. In particular, the present invention relates to an augmented hearing device comprising different types of receivers having different frequency responses associated therewith. The different types of receivers can be driven separately by using a switching function or in combination in order to save battery life of for example a hearing device.

BACKGROUND OF THE INVENTION

In-ear earphones, including wireless in-ear earphones and smart wireless in-ear earphones, are getting more popular since they can deliver fair sound quality while keeping small size and light weight. The challenge is to reproduce high sound quality while keeping the power consumption low, as these hearing devices operate with rechargeable batteries or are connected to a device which operates with a rechargeable battery. In order to deliver a high quality sound with wide band audio signal to the human eardrum professional in-ear monitors of today apply a plurality of receivers. As an example professional/premium in-ear monitors apply at least two balanced armature receivers where the audio signal from both receivers are filtered and combined in order to cover a wide audio bandwidth.

U.S. Pat. No. 7,194,103 B2 discloses an in-ear monitor comprising a moving coil receiver and a balanced armature receiver. The moving coil receiver is used as a woofer and thus provides a frequency response in a lower frequency band, whereas the balanced armature receiver is used as a tweeter and thus provides a frequency response in a higher frequency band. However, it is well established that balanced armature receivers are only efficient around their resonance frequency which typically is located in the speech frequency range, i.e. in the mid frequency range. Thus, the arrangement suggested in U.S. Pat. No. 7,194,103 B2 has its limitations in that it is not able to reproduce for example audio sound in the high frequency band.

The missing high frequency band is not compatible with hearing devices of today which should be able to perform both speech and music reproduction, the latter involving high frequency sound reproduction. Thus, the in-ear monitor suggested in U.S. Pat. No. 7,194,103 is not able to comply with this demand. Thus, there is a need for hearing devices having a broad frequency response.

U.S. Pat. No. 9,055,366 addresses a three-band speaker arrangement, i.e. woofer, mid and tweeter, where each speaker covers one frequency band. The tweeter is a balanced armature speaker, whereas the mid and/or woofer may be either balanced armature speakers or moving coil speakers. However, it is a disadvantage of the speaker system suggested in U.S. Pat. No. 9,055,366 that a total of three speakers is required to cover the complete frequency band in order to reproduce high quality audio sound.

US 2006/133636 A1 discloses a method for optimizing the audio performance of an earpiece which combines two drivers within a single earpiece. In this invention, each driver uses a discrete sound delivery tube. The focus in this patent application is to optimize the audio performance of wired earphones and hence not considering the energy saving optimization in wireless earpieces.

US 2011/058702 A1 discloses a multi driver in-ear monitor device (wired or wireless) with several embodiments to design tubing. The main focus in in-ear monitors are the high sound quality and optimizing delays between transmitter and receiver. This patent application does not deal with energy efficiency.

US 2014/205131 A1 discloses use of two balanced armature receivers in an earbud cup housing and several designs of the tubing to combine and improve the audio output quality of the drivers. In this disclosure, the difference between speech and music and also the energy efficiency of the battery operated earbuds are not addressed.

In the prior art references mentioned above, the drivers and balanced armature receivers are all driven at the same time and they are functioning together. The above-mentioned prior art references all target the music reproduction in the ear canal and do not distinguish between speech and music.

It may thus be seen as an object of embodiments of the present invention to provide a simple hearing device with enhanced acoustical performances.

It may be seen as a further object of embodiments of the present invention to provide a power saving hearing device.

It may be seen as a still further object of embodiments of the present invention to provide an augmented hearing device which is able to save power by selecting an appropriate number of receivers using a switching functionality.

DESCRIPTION OF THE INVENTION

The above-mentioned objects are complied with by providing, in a first aspect, an augmented hearing device comprising (i) a receiver of a first type being adapted to generate sound signals in a first and in a second frequency range, (ii) a receiver of a second type being adapted to generate sound signals in a third frequency range, said third frequency range being positioned between the first and second frequency ranges, and (iii) an input port for receiving signals to be reproduced as sound signals via at least one of the receivers.

The first type receiver may be structurally different from the second type receiver. As an example, the first type receiver may be a moving coil type receiver, whereas the second type receiver may be a moving armature type receiver.

It is advantageous to combine a moving coil type receiver and a moving armature receiver because such a combination will enable high quality sound reproduction covering both the low, mid and high frequency bands. Also, such a combination of receivers will offer a low-power speech reproduction mode of operation which may be controlled by a digital signal processor of the hearing device in order to optimize the energy efficiency of the hearing device.

The moving coil type receiver may advantageously cover two frequency ranges, namely the lower frequency range from 10 Hz to 1.5 kHz as well as the higher frequency range from 10 kHz to 20 kHz. The moving armature type receiver may cover the mid frequency range from 1.5 kHz to 10 kHz.

It should be noted however that the respective low, mid and high frequency bands may be selected differently. For example the frequencies separating the low, mid and high frequency bands, i.e. 1.5 kHz and 10 kHz, may be chosen differently.

The augmented hearing device may further comprise (i) a digital signal processor for processing signals from the input port, and (ii) a controllable switch for selecting between a plurality of modes of operation of the hearing device.

According to the present invention a first mode of operation may involve simultaneous operation of the first and second type receivers in order to generate audio sound, in particular high quality audio sound. In a second mode of operation only a single receiver is active in order to save power. This second mode of operation may involve speech reproduction where only the third frequency range is required, i.e. only the second type receiver is active. The second type receiver may be very efficient for the mid frequency range and may thus save the battery life of the hearing device if it is not in the music high sound quality reproduction mode.

The digital signal processor of the augmented may comprise an individual signal path for each of the first and second type receivers, each of said signal paths comprising a signal equalizer and a signal filter. Alternatively, the digital signal processor may comprise a common signal equalizer and a signal filter for each of the first and second type receivers.

The digital signal processor may further comprise control means for controlling the controllable switch. The controllable may comprise a compact high performance dual single-pole single-throw audio switch.

The input port of the augmented hearing device may be adapted to communicate wirelessly with an external device, such as communicate via Bluetooth. Typical external devices may involve cell phones, tables, laptops or other types of portable devices.

The first and second type receivers may form part of a single receiver, i.e. an integrated receiver module comprising both types of receivers optionally within the same housing. Alternatively, the first and second type receivers may be discrete receivers, i.e. separate receivers having their own housings.

In a second aspect the present invention relates to a method for operating an augmented hearing device comprising a receiver of a first type and a receiver of a second type, the method comprising the step of configuring the augmented hearing device in response to an input signal provided to the hearing device, wherein the step of configuring the augmented hearing device comprises a determination of whether only a single receiver or a plurality of receivers should be active. An active receiver is here to be understood as a receiver that generates sound.

In terms of operation both receivers, i.e. the receiver of the first type and the receiver of the second type, may be active if an audio signal is provided to the hearing device. In the present content an audio signal may be understood as for example a music signal. Alternatively, only a single receiver may be active if a speech signal is provided to the hearing device in order to optimize the energy efficiency of the hearing device.

BRIEF DESCRIPTION OF THE DRAWINGS

The present invention will now be described in further details with reference to the accompanying figures, wherein.

Figure 1:
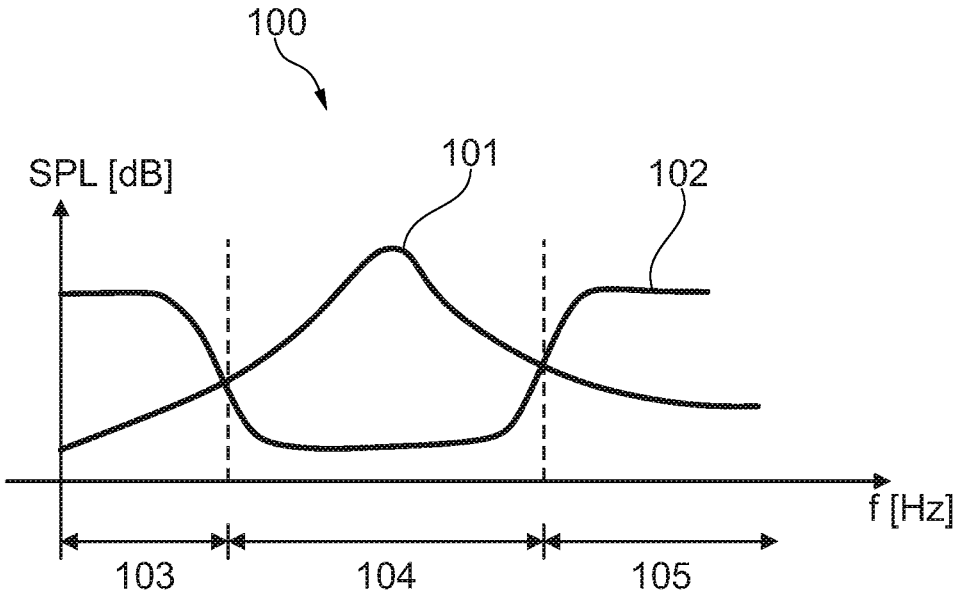
FIG. 1 illustrates how an enhanced frequency response could be composed.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect the prevent invention relates to a hearing device having an enhanced frequency response as well as being a power saving device. The enhanced frequency response is provided by combining a plurality of different types of receivers, such as balanced armature receivers and moving coil receivers. The power saving aspect is provided by operating the device in different modes of operation where the number of active receivers reflects the incoming signal to the device.

The hearing device of the present invention may in principle comprise an arbitrary number of receivers of different types. However, as the device of the present invention is an ear worn hearing device, the available space is rather limited. Thus, from a practical point of view the number of receivers is typically limited to a few receivers. In the following the present invention will be disclosed with reference to a hearing device comprising two receivers, namely a balanced armature receiver and a moving coil receiver. The present invention is by no means limited to this specific combination of receivers.

The hearing device of the present invention may thus combine two receivers in which one receiver is of a balanced armature type with a mid frequency boost whereas the other receiver is of a moving coil type with low and high frequency boosts. The combination of the two receivers will cover a wide bandwidth in which the moving coil generates the frequencies of 20 Hz to 1.5 kHz (low frequencies) and 10 kHz to 16 kHz (high frequencies). The mid frequency (speech frequency) range will be covered by the balanced armature, i.e. frequencies ranging from 1.5 kHz to 10 kHz. The balanced armature may for example have a resonance frequency around 3 kHz to compensate for the ear canal resonance.

The dimensions of the applied moving coil and balanced armature receivers should be as small as possible in order to minimize the size as well as the acoustical pathway design. The hearing device comprises a signal processing part that generates audio signals to the two receivers in response to an input signal.

The hearing device of the present invention may be operational in two modes of operation. In a music reproduction mode, within which the entire bandwidth, i.e. low-frequencies, mid-frequencies and high-frequencies, should be covered, the amplifier circuit drives both receivers. While the device is in speech communication and conversation mode (cell phone call), the moving coil receiver is switched off and only the balanced armature will deliver audio to the user's eardrum. The balanced armature receiver is very efficient in the speech frequency range and can be used alone to save power of the hearing device. Moreover, both receivers can be switched off in case there is no demand for delivering audio signals. It is advantageous that the selection between the music reproduction mode and speech and conversation mode will save power without compromising the sound quality.

With reference to FIG. 1 the underlying idea of the present invention 100 is depicted via the two different frequency response curves 101, 102. The two frequency response curves 101, 102 originate from (i) a compact moving coil receiver having a bath top frequency response 102. i.e., boosting the low 103 and high 105 frequencies, and (ii) a compact balanced armature receiver having a similar output level as the moving coil receiver 101 in the mid frequency range 104.

Figure 4:
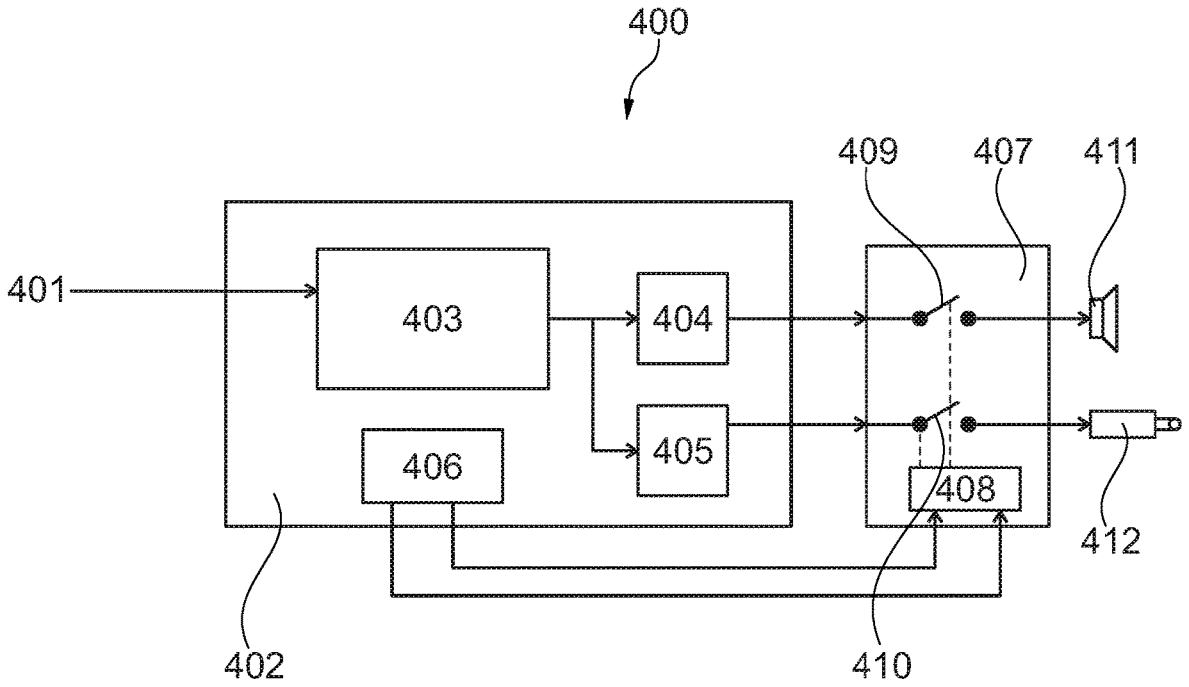
FIG. 4 shows a second embodiment of the present invention.
Figure 5:
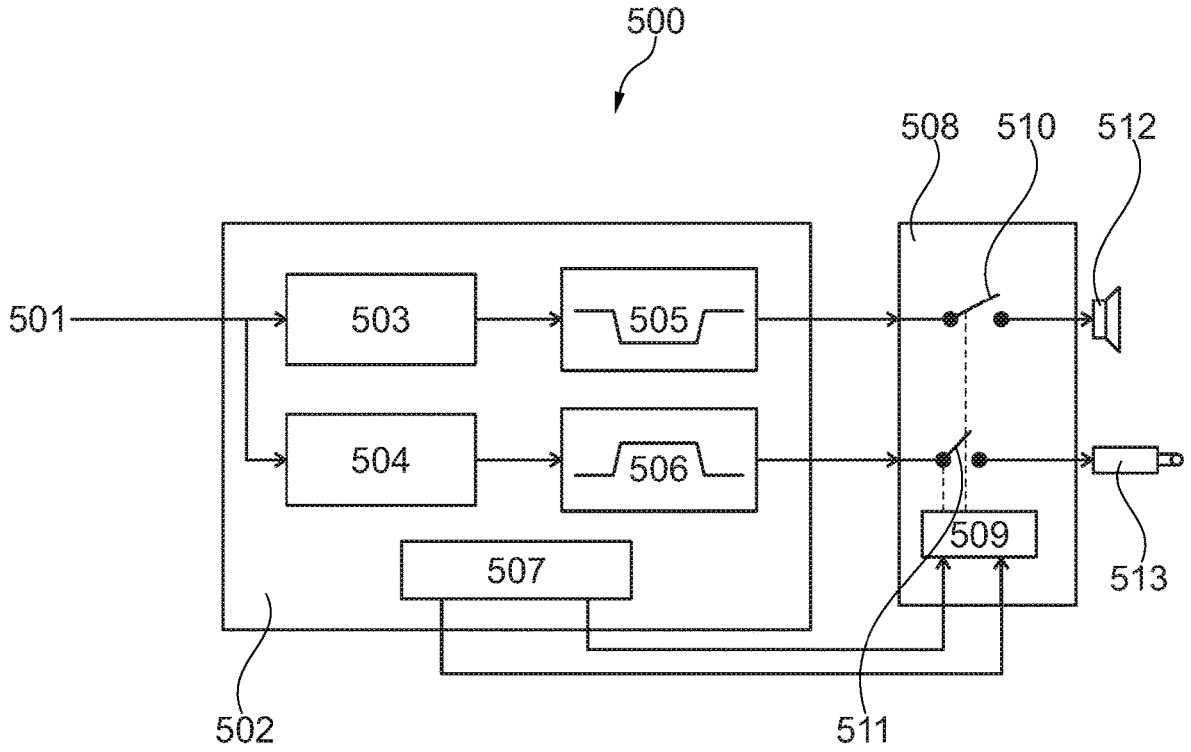
FIG. 5 shows a third embodiment of the present invention.

In order to be able to switch between the music reproduction mode and the speech and conversation mode, a compact high performance dual single-pole single-throw audio switch to control the drive signals to the two receivers needs to be provided as well, cf. FIGS. 4 and 5.

The bath top frequency response 102 of the moving coil receiver is provided by positioning one of the two main poles at the lowest possible resonance frequency, and positioning the other of the two main poles at the highest possible resonance frequency. According to FIG. 1, the balanced armature receiver is let to cover the mid frequency range 104. By nature, this is the frequency area where the balanced armature is very power efficient.

Figure 2:
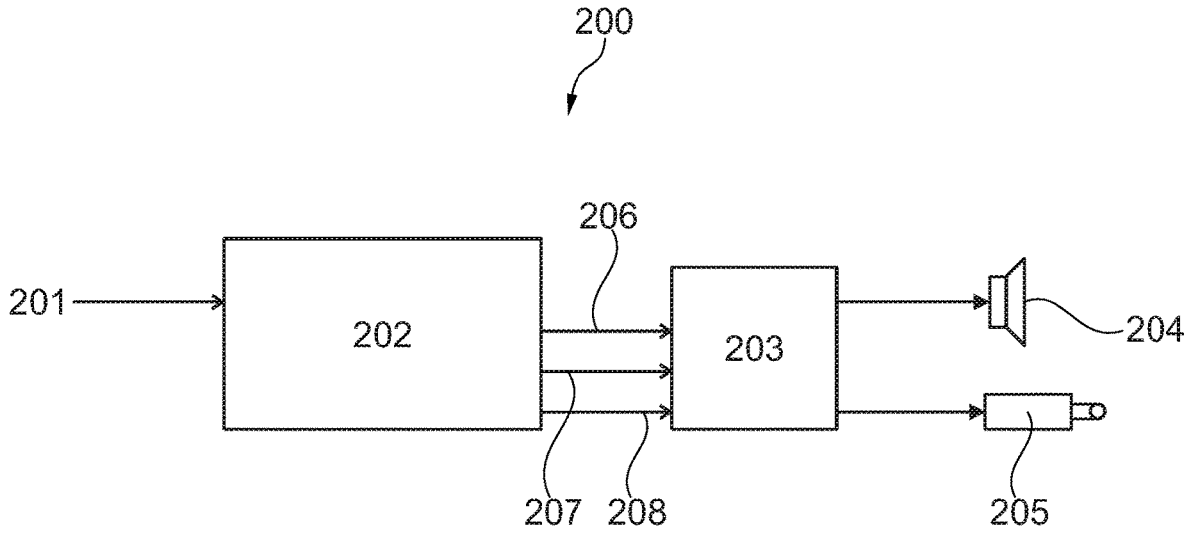
FIG. 2 shows the principle of the hearing device of the present invention.

Referring now to FIG. 2, the hearing device 200 may comprise a digital signal processor 202 (DSP) with audio input signal 201, an electronically controlled audio switch 203, one balanced armature receiver 205, and one moving coil receiver 204. The audio input signal 201 may originate from various sources, such as ambient sound from microphones, received speech from a conversation from a cell phone or streamed music from a cell phone or any other music player. The cell phone may be a Smartphone which is wirelessly connected to the hearing device.

Still referring to FIG. 2, the DSP 202 splits the drive signals to the receivers 204, 205 into individual signals 206, 207, where signal 206 drives the moving coil receiver 204, whereas drive signal 204 drives the balanced armature receiver 205. The third signal 208 includes one or more control signals for controlling the audio switch 203.

Figure 3:
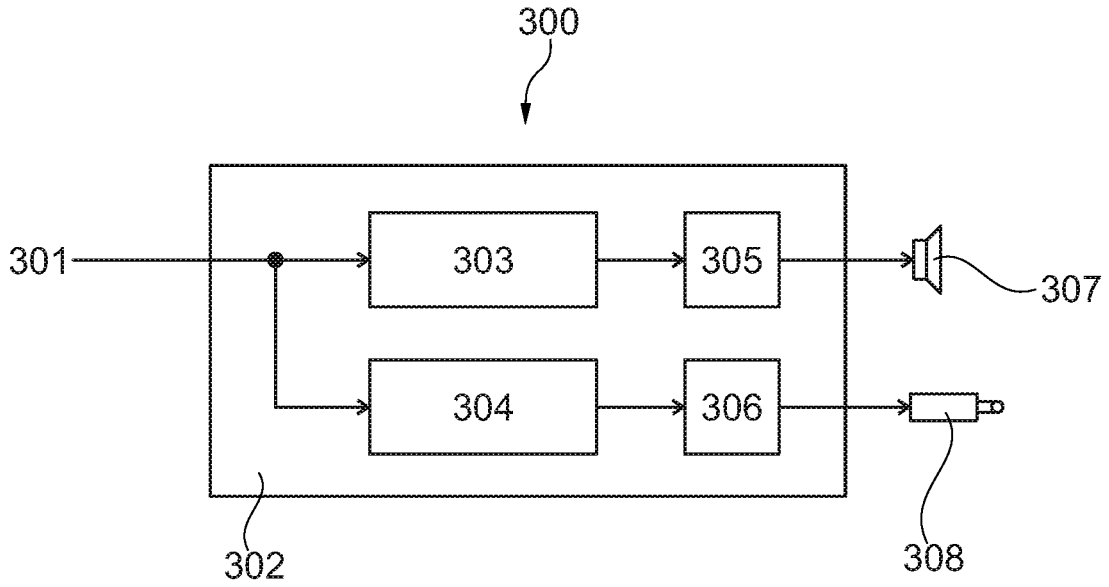
FIG. 3 shows a first embodiment of the present invention.

Referring now to FIG. 3, the DSP 302 of the hearing device 300 may have two separate paths to drive the two types of the receivers by using separate equalizers 303, 304. The output from the equalizer 304 for the balanced armature receiver 308 goes through a band-pass filter 306 before being fed to the balanced armature receiver 308. Similarly, the output from the equalizer 303 for the moving coil receiver 307 goes through a band-stop filter 305 before being fed to the moving coil receiver 307. The signal processor 302 is adapted to control the on/off switching of the moving coil 307 and the balanced armature receivers 308 depending on the nature of the incoming input signal 301.

FIG. 4 shows an alternative embodiment of the hearing device according to the present invention. In FIG. 4, the DSP 402 contains a single equalizer 403 for both the balanced armature receiver 412 and the moving coil receiver 411. Moreover, the DSP contains two filters 404, 405 and a control unit 406 adapted to generate two control signals in order to control the electronic audio switch 407 via the interface 408. The electronic audio switch 407 includes individual switches 409, 410 for switching signals to the moving coil receiver 411 or the balanced armature receiver 412 on or off, respectively.

Still referring to FIG. 4, the hearing device may be operated in a music reproduction mode where both the moving coil receiver 411 and the balanced armature receiver 412 are activated. Alternatively, the hearing device may be operated in a speech and conversation mode where only the balanced armature receiver 412 is activated. The mode of operation may be selected in response to the input signal 401 being provided to the DSP 403. If the input signal 401 is an audio signal the hearing device may automatically be set in a music reproduction mode. On the contrary, if the input signal 401 is a speech signal the hearing device may automatically be set in a speech and conversation mode where only the balanced armature receiver 412 is active in order to save power. If the input signal 401 has no or only little content both receivers 411, 412 may be switched off in order to save power even further.

In FIG. 5, the DSP 502 of the hearing device 500 comprises two equalizers 503, 504 for separately shaping the frequency for the balanced armature 513 and moving coil recievers 512, two separate filters 505, 506, and a control unit 507 adapted to generate two control signals to control an electronic audio switch 508 in order to switch the moving coil and/or the balanced armature on and/or off via controllable switches 510, 511 and interface 509.

The moving coil related filter 505 has a bath top frequency response, whereas the balanced armature receiver 506 has a band-pass frequency response. As an example equalization for the moving coil receiver 512 may involve to boost the frequencies around 17 kHz without increasing the power consumption. Again, the mode of operation (speech and conversation mode or music production mode) may be selected in response to the input signal 501 being provided to the DSPs 503, 504.

In another and not depicted architecture, two separate DSPs can be used to drive the two receivers. In this architecture, one DSP can be optimized for wireless communication (phone calls, and speech and conversation mode via Smartphone) where only the balanced armature receiver is active, whereas the other DSP can be optimized for music reproduction where both the moving coil and the balanced armature receiver are active, i.e. switched on.

Figure 6:
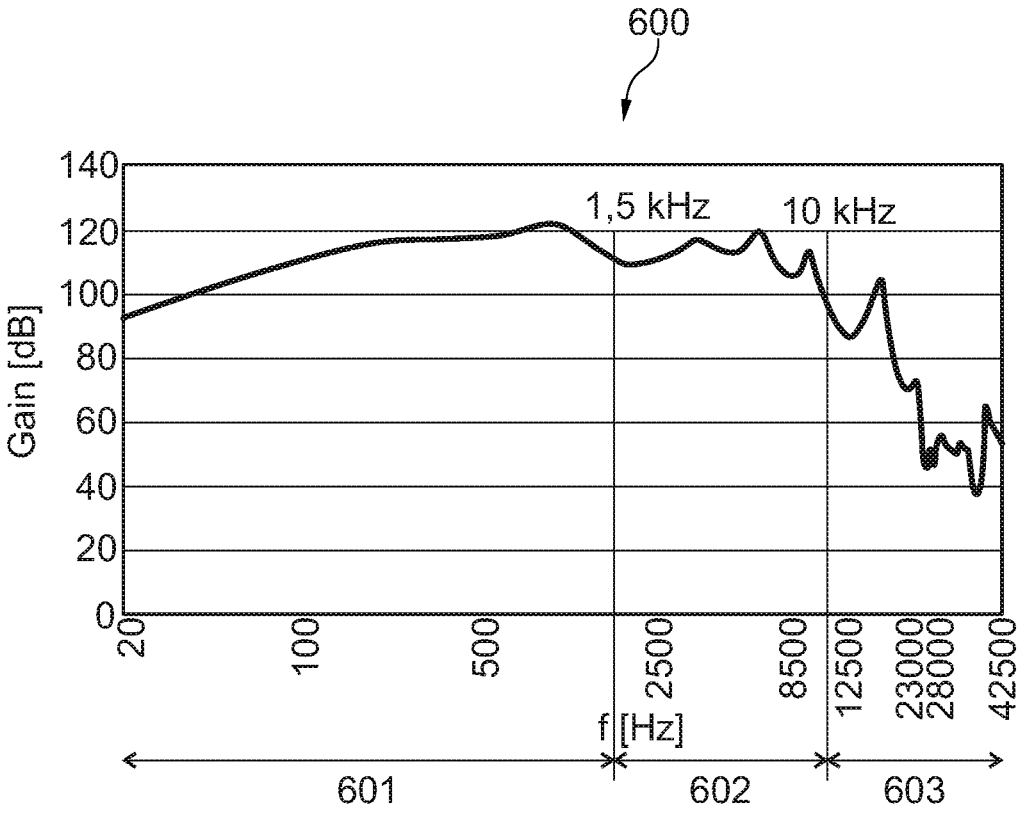
FIG. 6 shows the frequency response of a hearing device comprising a balanced armature receiver and a moving coil receiver.

FIG. 6 shows an example of a frequency response 600 of a hearing device comprising a moving coil receiver and a balanced armature receiver. In FIG. 6, the moving coil receiver is responsible for the lower and higher frequency ranges 601, 603 whereas the balanced armature receiver is responsible for the mid frequency range 602.

Figure 7:
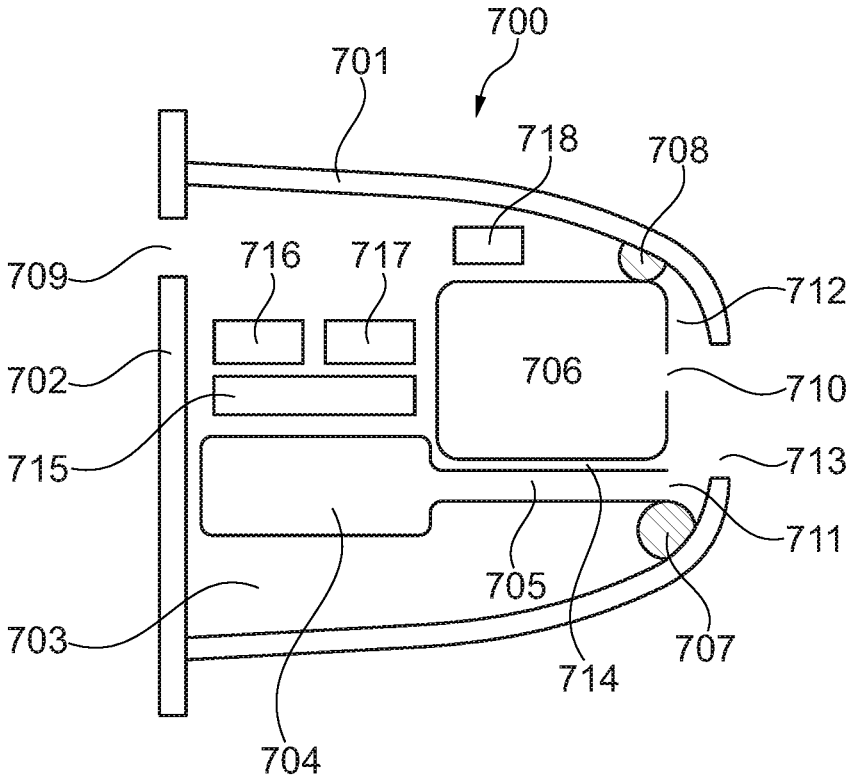
FIG. 7 shows a hearing device comprising a balanced armature receiver and a moving coil receiver.

Turning now to FIG. 7, the hearing device 700 of the present invention comprises a sound outlet opening 713 which combines the outputs 711, 710 from balanced armature receiver 704 and moving coil receiver 706 in the best efficient way, i.e. in a way where the high frequencies generated by moving coil receiver 706 are not attenuated. For the best high frequency response from moving coil receiver 706, the moving coil receiver 706 should be positioned as close as possible to the sound outlet 713 in order to have the shortest acoustical path thereto.

As previously stated, the high frequency response is provided by the moving coil receiver 706. In order to achieve this, the acoustical induction and compliance in front of the membrane of the moving coil receiver 706 must be as low as possible. In practice this can be established by designing a large sound outlet opening 710 in a front cover of the moving coil receiver 706 as well as using a thin material as the front cover. Moreover, the moving coil receiver 706 must be positioned as close as possible to the sound outlet opening 713 in the front shell 701 of the device in order to reduce the air volume 712 here. In addition thereto, the sound outlet opening 713 in the front shell 701 must have an acoustical inductance being as low as possible. To achieve this the opening 713 in the front shell 701 should be large and the wall thickness of the front shell 701 at the opening 713 should be as thin as possible.

The low frequency response is provided by letting the moving coil receiver 706 have a very low mechanical resonance, and at the same time ensure that the ear piece fit is completely sealed so that no leakage of the bass content will occur. The bass sealings 707, 708 are shown in FIG. 7. The hearing device shown in FIG. 7 further comprises an energy source in the form of a battery 715, a digital signal processor 716 for processing the various signals, an antenna structure 717 for communicating with the outside world in a wireless manner, and a sensor 718. The antenna structure 717 can be used for various types of wireless communication, including Bluetooth, Low Energy/Smart Bluetooth or Near Field Magnetic Induction (NFMI), or for wireless charging. The sensor 718 may in principle be any kind of sensor, including medical/health sensors, vibration sensors, accelerometers/gyroscopes, acoustic sensor etc. A medical/health sensor may be used to monitor the heart rate, the body temperature, oxygen measurements etc. A vibration sensor may be used for voice pickup of the user's own voice, tap detection etc. An accelerometer/gyroscope may be used for step count, cadence measurements etc., whereas an acoustic sensor or microphone may be used for communication purposes, directionality measurements, noise cancelling etc.

Thus, for optimizing the high frequency performance the moving coil receiver 706 should be placed as close as possible to the opening 713 in order to keep front air volume 712 as small as possible. As seen in FIG. 7, the moving coil receiver 706 is positioned in front of the balanced armature receiver 704. The output from the balanced armature receiver 704 is led to the opening 713 via a tube connection 705. This tube connection 705 and its acoustical induction will not create an equalizing problem, because the balanced armature receiver 704 is intended to cover the mid frequencies only.

Optionally, a tube connection (not shown in FIG. 7) may be established from the front side to the rear side of the receivers 704, 706. Such a tube connection will preload the bass content so that the influence of a leakage between ear canal and the device shell 701 will only have a minor effect to the sound impression (leak friendly performance). Alternatively, a free passage 714 between the two receivers may be used for venting purposes.

Finally, a controlled opening 709 is designed from the inner cavity 703 of the device and out to the free field. This opening 709 is needed because the volume of the inner cavity 703 of the device is so small, i.e. approximately 500 $mm^3$. Without such an opening 709 in the back plate 702 there would be basically no bass reproduction because the membrane of the moving coil receiver 706 would be restricted in its high amplitude excursions needed for bass reproduction. The two receivers 704, 706 are shielded (separated enough) in order to avoid any magnetic effects from one to the other.

Optionally, the venting passage 714 can be closed when the wearable acoustic device is operated in the speech and conversation mode, and opened when the device is operated in the music reproduction mode.

The invention claimed is:

1. An augmented hearing device comprising:

a) a receiver of a first type comprising a single membrane, the receiver being adapted to generate, using the single membrane, sound signals in a first and in a second frequency range, b) a receiver of a second type being adapted to generate sound signals in a third frequency range, said third frequency range being positioned between the first and second frequency ranges, c) an input port for receiving signals to be reproduced as sound signals via at least one of the receivers, and d) a digital signal processor for processing signals received via the input port, and for adjusting the frequency content of a drive signal to at least one of the receivers.

2. An augmented hearing device according to claim 1, wherein the digital signal processor is adapted to adjust the frequency content of the drive signal to at least one of the receivers in response to signals received via the input port.

3. An augmented hearing device according to claim 1, wherein the first type receiver is structurally different from the second type receiver.

4. An augmented hearing device according to claim 1, wherein the first type receiver is a moving coil type receiver.

5. An augmented hearing device according to claim 4, wherein first frequency range comprises the frequency range from 10 Hz to 1.5 kHz, and wherein the second frequency range comprises the frequency range from 10 kHz to 20 kHz.

6. An augmented hearing device according to claim 1, wherein the second type receiver is a moving armature type receiver.

7. An augmented hearing device according to claim 6, wherein the third frequency range comprises the frequency range from 1.5 kHz to 10 kHz.

8. An augmented hearing device according to claim 1, further comprising a controllable switch for selecting between a plurality of modes of operation of the hearing device.

9. An augmented hearing device according to claim 8, wherein a first mode of operation involves simultaneous operation of the first and second type receivers in order to generate audio sound.

10. An augmented hearing device according to claim 8, wherein a second mode of operation involves operation of only a single receiver.

11. An augmented hearing device according to claim 8, wherein the digital signal processor further comprises control means for controlling the controllable switch.

12. An augmented hearing device according to claim 1, wherein the digital signal processor comprises an individual signal path for each of the first and second type receivers, each of said signal paths comprising a signal equalizer and a signal filter.

13. An augmented hearing device according to claim 1, wherein the digital signal processor comprises a common signal equalizer and a signal filter for each of the first and second type receivers.

14. An augmented hearing device according to claim 1, further comprising a battery, an antenna structure and one or more medical/health sensors, vibration sensors, accelerometers/gyroscopes, acoustic sensors and/or microphones.

15. An augmented hearing device according to claim 1, wherein the input port is adapted to communicate wirelessly with an external device.

16. An augmented hearing device according to claim 15, wherein the input port is adapted to communicate wirelessly with an external device via Bluetooth.

17. An augmented hearing device according to claim 1, wherein the first and second type receivers form part of a single receiver.

18. An augmented hearing device according to claim 1, wherein the first and second type receivers are discrete receivers.

19. A method for operating an augmented hearing device comprising a receiver of a first type and a receiver of a second type, the method comprising the step of configuring the augmented hearing device in response to an input signal provided to the hearing device, wherein the step of configuring the augmented hearing device comprises an adjustment of the frequency content of a drive signal to at least one of the receivers, wherein only a single receiver is active if a speech signal is provided to the hearing device in order to save power.

20. A method according to claim 19, wherein the step of configuring the augmented hearing device further comprises a determination of whether only a single receiver or a plurality of receivers should be active.

21. A method according to claim 20, wherein both receivers are active if an audio signal is provided to the hearing device.

22. An augmented hearing device comprising:

a) a receiver of a first type and a receiver of a second type, wherein the receiver of the second type is adapted for reproduction of speech, and wherein the first and second types of receivers, when being operated simultaneously, are adapted for reproduction of audio sound, wherein only the second type of receiver is active if a speech signal is provided to the hearing device in order to save power, b) an input port for receiving signals to be reproduced as sound signals via at least one of the receivers, and c) a digital signal processor adapted to process signals received via the input port, and control the receivers in response to signals received via the input port.

* * * * *